US006055693A

United States Patent [19]

Lehr et al.

[11] Patent Number: 6,055,693

[45] Date of Patent: May 2, 2000

[54] RAILWAY SHORT SPAN TRESTLE BRIDGE

[75] Inventors: Bradley R. Lehr, Omaha; Jerry Martin, Lincoln; Mark V. Holland; Mark L. McCune, both of Omaha, all of Nebr.

[73] Assignee: Owen Industries, Inc., Omaha, Nebr.

[21] Appl. No.: 08/580,191

[22] Filed: Dec. 28, 1995

[51] Int. Cl.[7] ..... E01B 2/00

[52] U.S. Cl. ..... 14/73; 14/74.5; 14/77.1; 238/2

[58] Field of Search ..... 14/2.4, 6, 69.5, 14/73, 74.5, 77.1; 238/2, 3, 6, 7; 404/30, 70, 73

[56] References Cited

U.S. PATENT DOCUMENTS

| | | | |
|---|---|---|---|
| 609,790 | 8/1898 | Capewell . | |
| 2,161,105 | 6/1939 | Strauss . | |
| 3,587,964 | 6/1971 | Cork | 238/2 |
| 4,300,721 | 11/1981 | Rich | 238/2 |
| 4,301,565 | 11/1981 | Weinbaum | 14/1 |
| 4,493,177 | 1/1985 | Grossman | 52/745 |
| 4,710,994 | 12/1987 | Kishida et al. | 14/1 |
| 4,884,384 | 12/1989 | Ljungkvist et al. | 52/745.05 |
| 4,972,537 | 11/1990 | Slaw, Sr. | 14/1 |
| 5,145,278 | 9/1992 | Lohrmann | 404/6 |
| 5,603,134 | 2/1997 | Whipkey et al. | 14/2.4 |
| 5,651,154 | 7/1997 | Ahlskog et al. | 14/6 |
| 5,720,067 | 2/1998 | Grearson | 14/73 |
| 5,771,518 | 6/1998 | Roberts | 14/73.1 |

FOREIGN PATENT DOCUMENTS

| | | | |
|---|---|---|---|
| 38095 | 11/1988 | Germany | 404/73 |

OTHER PUBLICATIONS

"Structural Steel Design" by Joseph Bowles, p. 187 (McGraw Hill, 1980).

*Primary Examiner*—James A. Lisehora
*Attorney, Agent, or Firm*—Brinks Hofer Gilson & Lione

[57] ABSTRACT

A railway short span trestle is designed for quick erection at an installation site by assembly of a minimum number of parts. Those parts include a pair of spaced apart girders and whatever number of modular floor assemblies are required to span the length of those girders. Each floor assembly may be preassembled in the shop to include crossbeams for connection to the girders, a ballast floor plate which interconnects the crossbeams, and the bent curb plates which contain and support the ballast for a railway track. The invention is further directed to a method of constructing a railway short span trestle including tho preassembly of the modular floor assemblies and final connection of those floor assemblies to a pair of girders to provide a unitary trestle ready for placement onto a substructure.

18 Claims, 7 Drawing Sheets

RAILWAY SHORT SPAN TRESTLE BRIDGE

BACKGROUND OF THE INVENTION

1. Technical Field

The present invention is directed generally to a railway short span trestle and more particularly to such a trestle which may be preassembled in the shop for delivery of a minimum number of parts to a site for quick efficient erection and installation onto the substructure.

2. Description of the Prior Art

The replacement of old existing short span railway trestles is a necessary part of track maintenance both because of the age of existing trestles and the insufficient load limits for which they were designed. Existing steel trestles were most commonly assembled by field welding all parts. That was extremely time consuming, labor intensive and expensive. The custom design of each trestle for a given site further complicated erection, installation and subsequent repairs became of the many non-standard parts. Another disadvantage of existing short span trestles is that they generally required pile bents every 20 or 30 feet.

An important consideration in trestle replacement is to minimize track down time. Replacement of steel trestles with prefabricated concrete trestles may result in a substantial increase in the vertical distance between the ballast deck plate and the bottom of the trestle thereby requiring road work leading up to the trestle from both sides and the substantial expense and down time associated therewith. Road work over approximately 800 feet of track may be required to accommodate a 1½ foot rise in the track due to trestle replacement with trestles of precast concrete construction. The precast concrete replacement trestles are very heavy and require bigger and perhaps multiple cranes in the field for installation.

Further problems associated with replacement of existing railway short span trestles with conventional trestles are that the existing trestle often needs to be removed or modified before construction of piles for the new trestle, thereby substantially increasing track down time and/or requiring a reduction of allowable train speeds across an existing trestle. Finally, it is a perpetually difficult task to transport, organize, and find all of the custom parts that need to be field welded together at the site for construction of a replacement steel trestle.

Accordingly, a primary object of the present invention is to provide an improved railway short span trestle and method of installation.

Another object is to provide such an improved trestle and method which enable minimum track down time for trestle replacement.

A more specific object is to provide such a trestle and method which enable piles for a new trestle to be driven outside of the existing structure prior to removal of the existing structure.

A related specific object of the invention is to provide such a trestle and method which enable the new trestle to be assembled off-pier for placement as a single unit onto new pile caps.

Another object is to provide such a trestle and method which result in a steel trestle weighing substantially less than a comparable concrete span.

A related object is to provide such a trestle and method which require fewer or a smaller crane in the field for the trestle replacement operation.

Another object is to provide such a trestle and method with a minimum number of parts to be assembled in the field.

A related specific object is to provide such a trestle and method which enable stocking standard floor assemblies which may be assembled in various combinations for given span lengths.

Another related specific object is to provide such a trestle and method which minimize required field labor for trestle replacement.

A related specific object of the invention is to provide an improved trestle and method with high quality welds due to substantial shop welding of subassemblies prior to delivery of those subassemblies to a site.

Another object of the invention is to provide such a trestle and method which enable quick delivery of replacement parts due to prefabrication of standard subassemblies and storage of those parts at multiple sites.

Another object of the invention is to provide such a trestle and method which provides a trestle with minimum vertical distance from the top of the ballast floor plate to the bottom of the girders.

A related specific object of the invention is to provide such a trestle and method wherein the distance from the top of the ballast floor plate to the bottom of the girder is less than 2 feet.

A related specific object of the invention is to provide such a trestle and method which require minimum road work in any given trestle replacement.

Another object of the invention is to provide such a trestle and method with decreased substructure requirements, namely fewer bents of piles for lower cost.

A further object of the invention is to provide such a trestle and method which require little maintenance over the life of the trestle.

A final object of the invention is to provide an improved railway short span trestle which is simple and rugged in construction and efficient in operation.

SUMMARY OF THE INVENTION

The railway short span trestle of the present invention is designed for preassembly of modular floor assemblies in a shop for delivery with a pair of first and second girders to the site of trestle installation so that erection simply requires final assembly of the first and second girders and the preassembled floor assemblies at the site. The preassembled floor assemblies are supported on and between the girders in adjacent relation to collectively provide a floor substantially spanning the length of the girders and operative to support ballast, ties and tracks substantially spanning the length of the girders. Each floor assembly includes a plurality of cross beams, preferably two, and a ballast floor plate supported on and secured to the cross beams to maintain the spacing between them prior to final assembly with the girders.

Each floor assembly may further include opposite bent curb plates secured to the respective ballast floor plate in transversely spaced relation and extending upwardly and outwardly therefrom in diverging relation to one another for containing ballast on the floor to support railway tracks thereon. The cross beams of each floor assembly are supported above the bottom flanges of the girders so that the floor assemblies are situated entirely within the vertical extent of the first and second girders.

To connect the floor assemblies to the girders, a plurality of girder stiffener angles having perpendicular legs with a plurality of bolt holes therein, are rigidly secured to the web of a respective girder in spaced apart relation for abutment with the cross beams of the floor assemblies, the girder stiffener angles and cross beams having aligned bolt holes with nut and bolt assemblies extended through them for rigidly securing the floor assemblies to the girders.

The modular floor assemblies include a plurality of intermediate floor assemblies and a pair of opposite end floor assemblies. Each floor assembly includes a center cross beam generally centered below the ballast floor plate and an end cross beam adjacent one end of the ballast floor plate. In the intermediate floor assemblies, the end cross beam extends beyond the ballast floor plate to also support the ballast floor plate of an adjacent floor assembly. In an end floor assembly, the ballast floor plate covers the end cross beam and extends beyond it.

Each bent curb plate may include a bottom generally horizontal foot portion,, an intermediate inclined wall portion and a generally upright top wall portion. Bracing is provided between the bent curb plates and girders to support the bent curb plates against the loads imposed through the tracks and ballast on the floor assemblies. That bracing may include a back up plate underlying and secured to the inclined wall portions of each adjacent pair of bent curb plates as well as T-braces secured to and extending between each bent curb plate and the adjacent girder.

The girders may be provided as welded plate girders, each having a bottom flange extending transversely inwardly from the web toward the opposite girder to a greater extent than the top flange so that floor assemblies may be lowered between the top flanges for placement onto the bottom flanges during erection.

The invention furthermore contemplates a novel method of constructing a railway short span trestle including the steps of preassembling the plurality of floor assemblies, delivering the preassembled floor assemblies and first and second girders to an installation site. The first and second girders are arranged in generally parallel spaced apart relation and the floor assemblies are supported on and between the first and second girders in adjacent relation to collectively provide a floor substantially spanning the length of the girders. The floor assemblies are then connected to the first and second girders to provide a unitary trestle. Erection will most commonly be done off-pier with the fully erected trestle then rolled into position or lifted by a crane for placement as a unit onto the substructures.

DESCRIPTION OF THE PREFERRED EMBODIMENT

Figure 1:
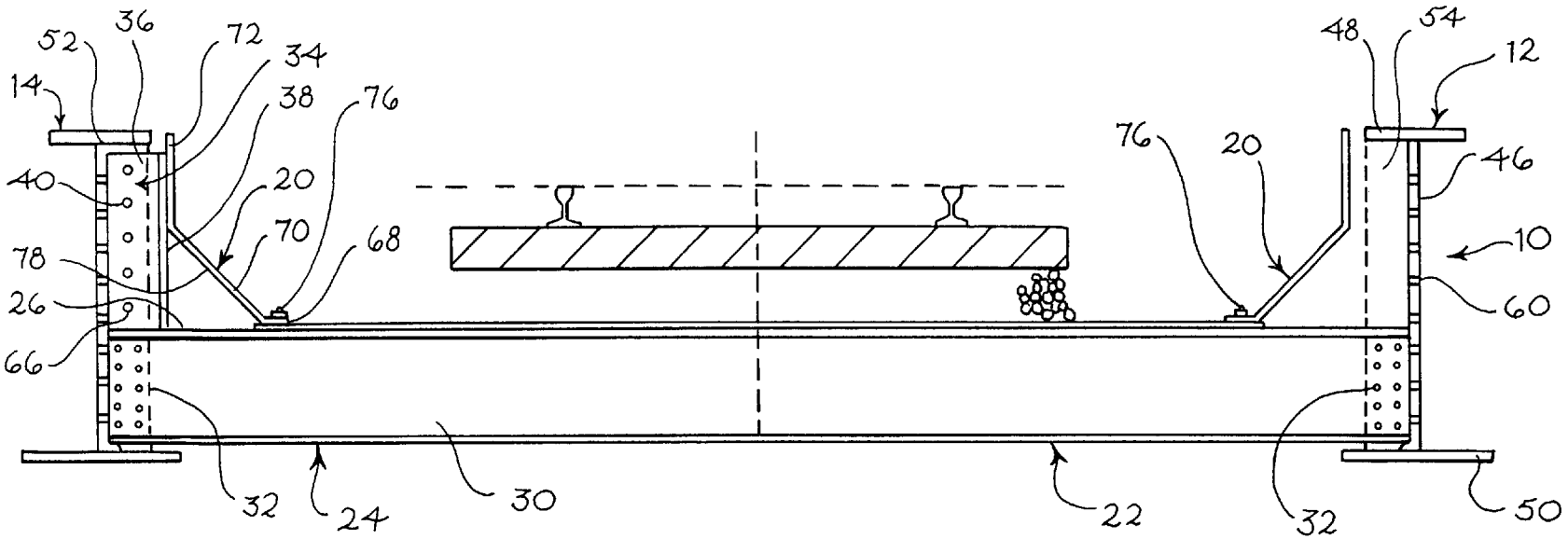
FIG. 1 is an end view of the erected trestle without the abutment bearing plates for securement to a substructure.
Figure 2:
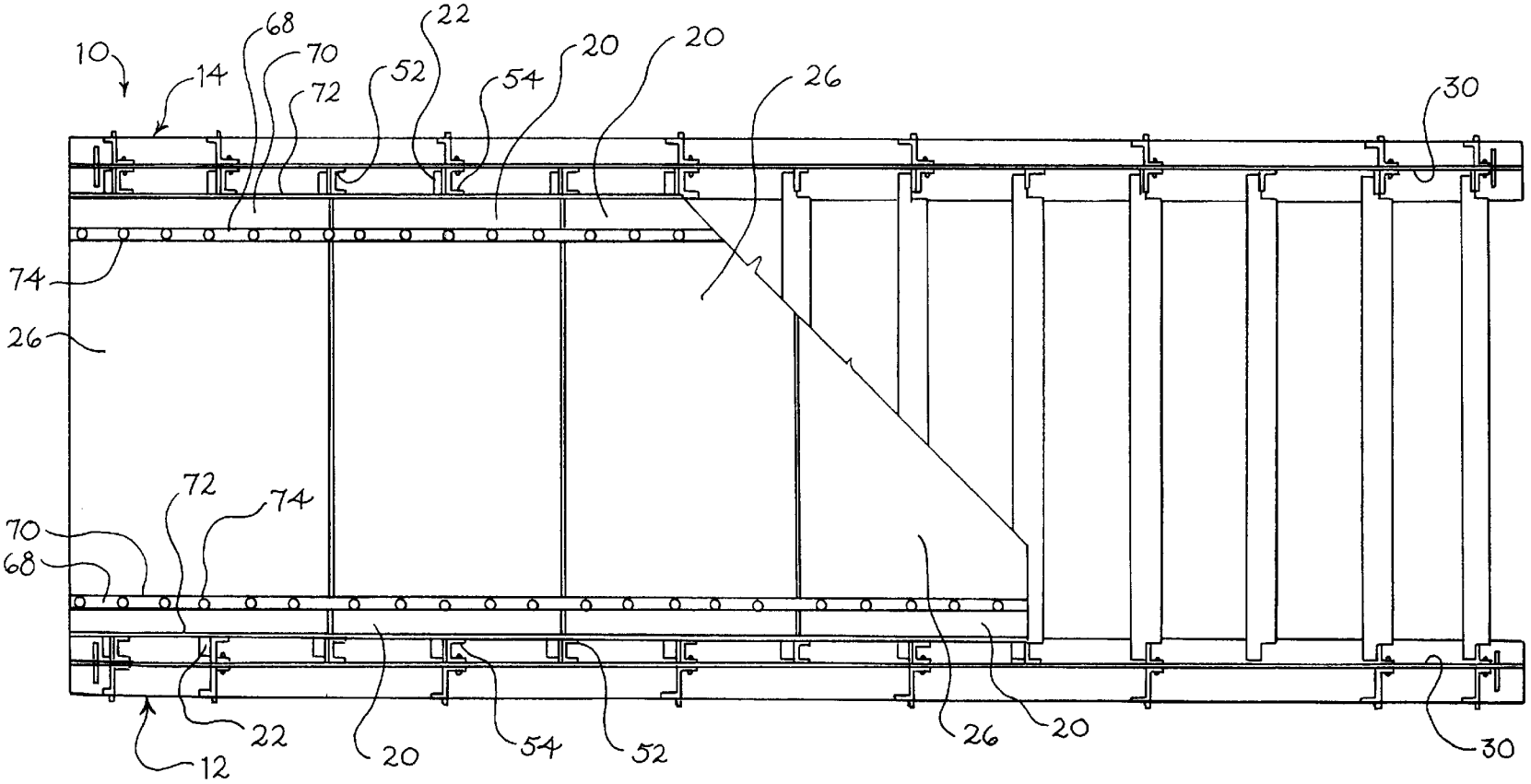
FIG. 2 is a plan view of the erected trestle of FIG. 1 with the ballast floor plates and bent curb plates of certain floor assemblies removed to expose the underlying cross beams.

The railway short span trestle 10 of the present invention is shown in FIGS. 1 and 2 as including first and second girders 12 and 14, four intermediate floor assemblies 16 and two end floor assemblies 18. Of course the number of modular floor assemblies will vary depending upon the overall length of a given trestle but the modular construction enables the same preassembled floor assemblies to be used in various combinations to accommodate different overall spans. The overall span of the illustrated trestle is 50 feet, it being constructed with four intermediate floor assemblies 16, each 8 feet in length, and two end floor assemblies 18, each 9 feet in length. Like reference numerals will be used to describe like parts of the intermediate and end floor assemblies 16 and 18, with the letter "i" used in connection with the end floor assembly 18 to indicate that it is longer than its counterpart in the intermediate floor assembly 16 by a fixed distance such as the one foot increment for the illustrated embodiment.

Figure 10:
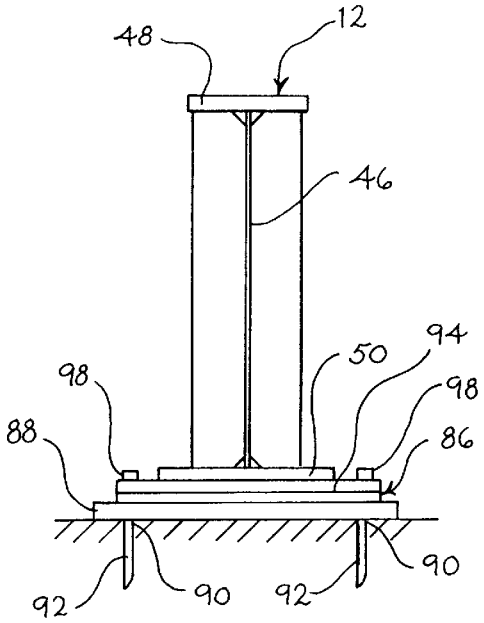
FIG. 10 is an end view of the abutment bearing plates for supporting an end of each girder.
Figure 11:
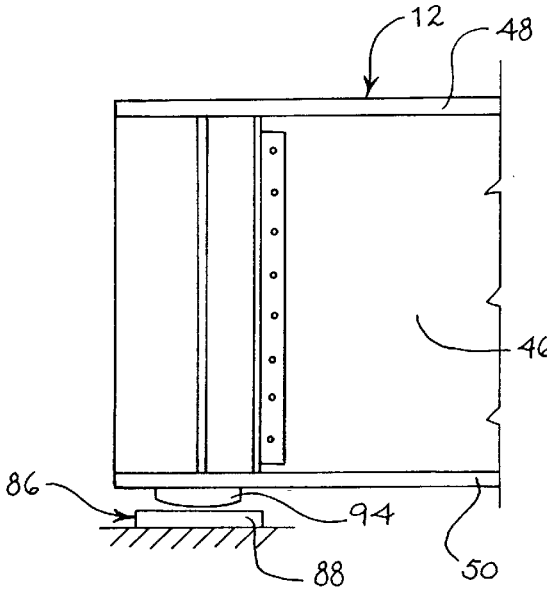
FIG. 11 is a partial side view of the abutment bearing plates of FIG. 10.

The illustrated embodiment is referred to as a 48'0" steel trestle span since 48 feet is the distance between the centers of the abutment bearings at opposite ends of the trestle, as illustrated in FIGS. 10 and 11. This trestle includes the eight shipping pieces described above, namely two girders 12 and 14, four intermediate floor assemblies 16, two end floor assemblies 18 and two abutment bearings or pile caps, as illustrated in FIGS. 10 and 11. Field assembly will be made with 330 nut and bolt assemblies and approximately 60 linear feet of partial penetration field weld at the splices of the floor assemblies 16 and 18. In comparison, a conventional steel trestle for only a 40 feet span has a total of ninety-seven shipping pieces and three hundred seventy-eight nut and bolt assemblies for assembly in the field. The above numbers will change with the addition or deletion of one or more intermediate floor assemblies 16 but the number of parts requiring field assembly remains substantially less than what is required for conventional steel trestles having a comparable span length.

Figure 3:
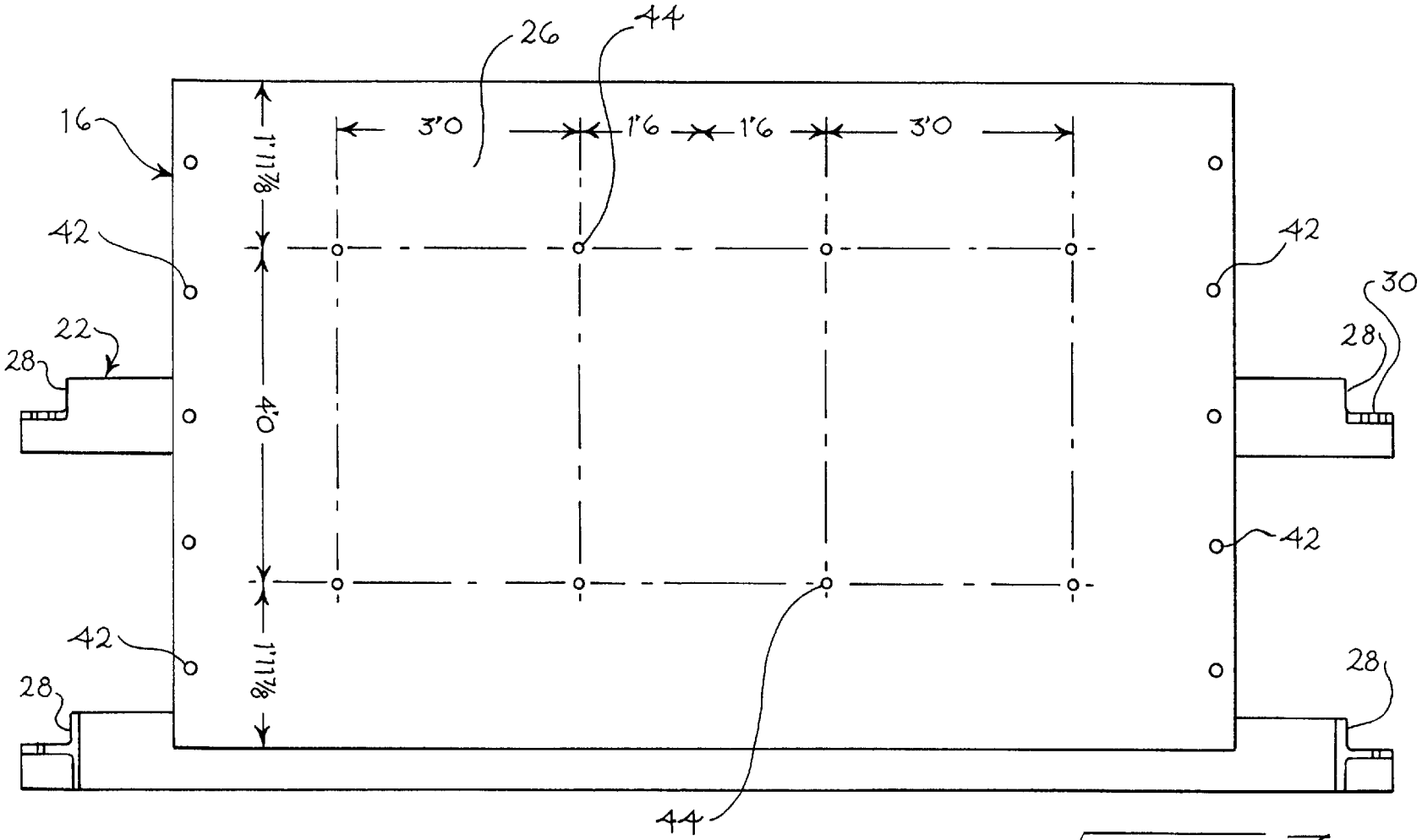
FIG. 3 is a top plan view of the cross beams and ballast floor plate of an intermediate floor assembly.
Figure 4:
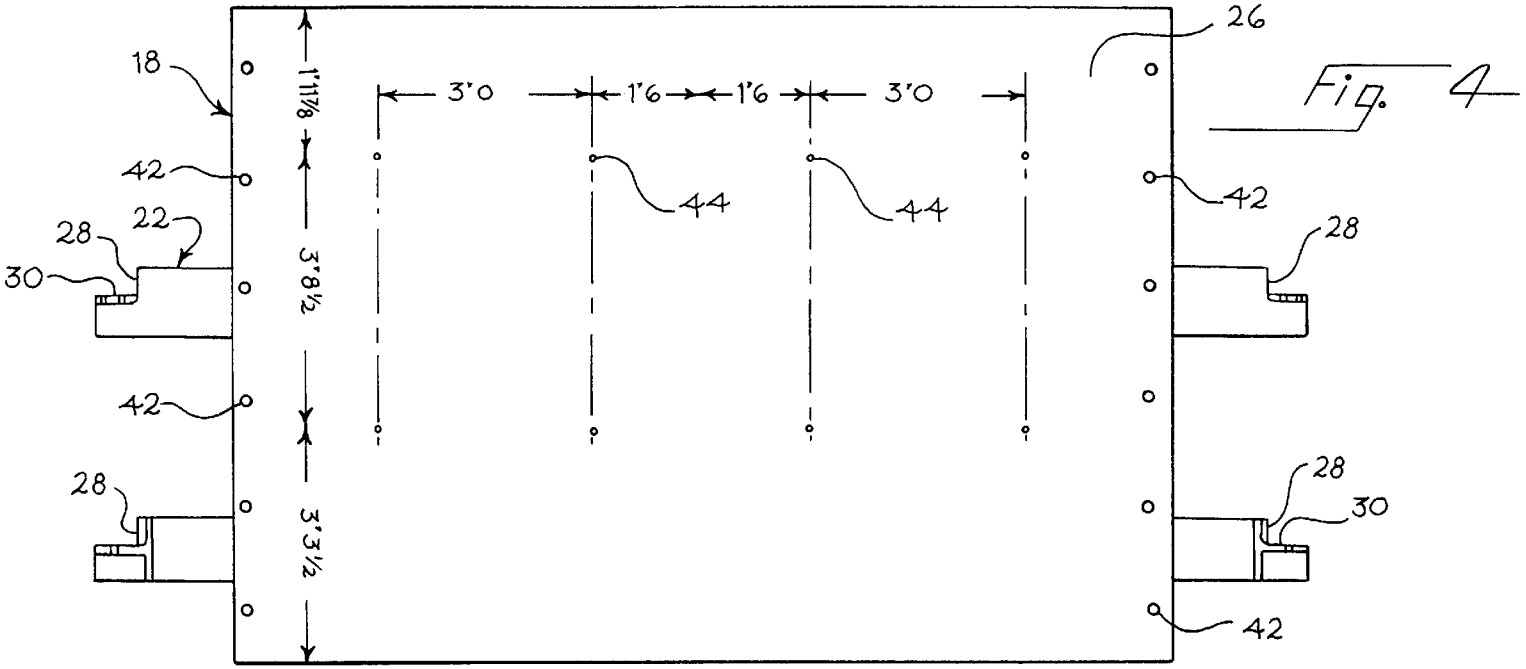
FIG. 4 is a plan view of the cross beams and ballast floor plate of an end floor assembly.
Figure 5:
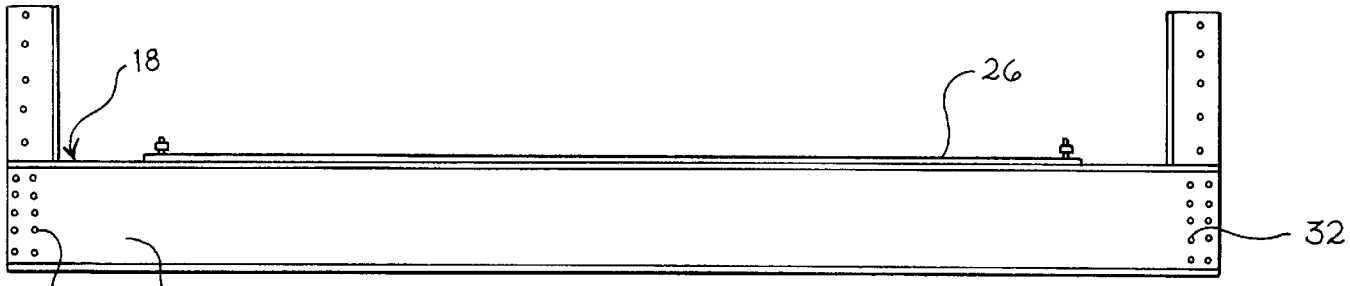
FIG. 5 is an end elevational view of a floor assembly.

Each floor assembly 16 and 18 includes a pair of bent curb plates 20 as shown in FIG. 1. FIG. 3 illustrates certain components of an intermediate floor assembly 16, namely center crossbeam 22, end crossbeam 24 and ballast floor plate 26. The floor plate is shop welded to both crossbeams to establish and maintain the precise spacing between the crossbeams that is required for field assembly to the girders. Each crossbeam in the illustrated embodiment is a welded plate girder with the top and bottom flanges of each notched at both ends on one side as at 28 in FIG. 3 to expose opposite end portions of the web 30 for connection to the girders 12 and 14. Each exposed end of the crossbeam web is provided with a series of ten bolt holes 32. End cross beam 24 differs from center cross beam 22 in that it additionally includes a pair of upright T braces 34 mounted on the top of end cross beam 24 adjacent the ends of the crossbeam, and each having a web 36 aligned with the web of beam 24 and an upstanding top flange 38 adapted for bracing the bent curb plates 20, as shown in FIG. 1. The web 36 of T-brace 34 has a vertical array of five bolt holes for securement to a girder.

The ballast floor plate 26 in the preferred embodiment is a ⅞th inch thick steel plate. A linear array of bolt holes 42 is provided along both edges of ballast floor plate 26 for securing the bent curb plates 20 thereto. Likewise, a generally rectangular array of eight drain holes is provided at the positions illustrated in FIG. 3. The material of this plate and all other structural members is preferably ASTM A709 GR 50 W which is a weathering steel that will provide minimum maintenance for the life cycle of the structure.

Figure 6:
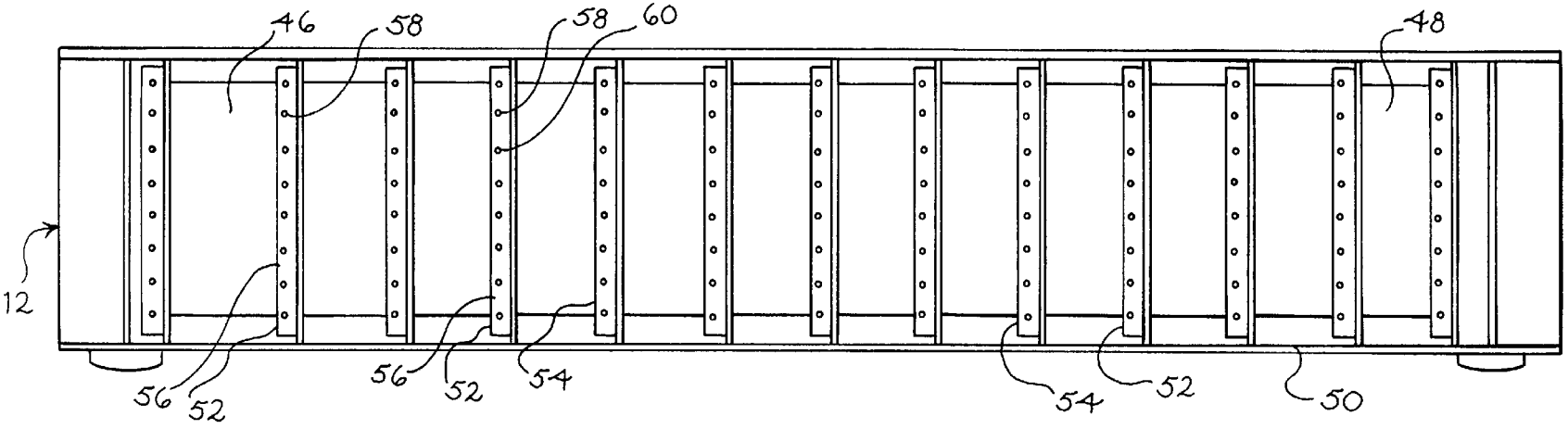
FIG. 6 is a side elevational view of a girder of the trestle, the opposite girder being the mirror image of the illustrated girder.
Figure 7:
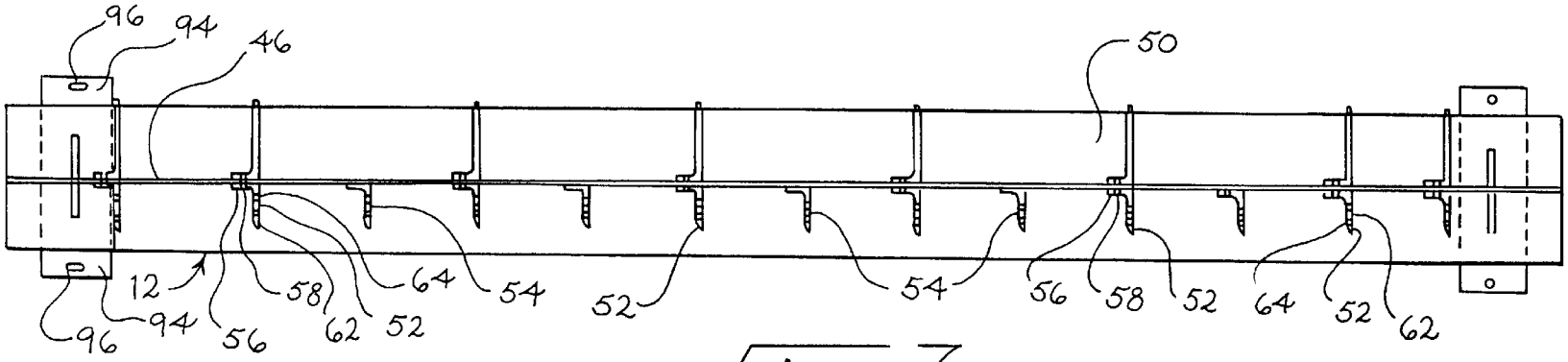
FIG. 7 is a top sectional view through the girder of FIG. 6.
Figure 8:
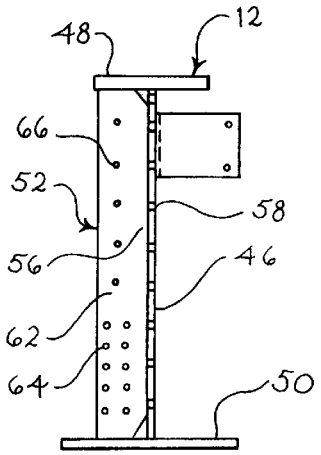
FIG. 8 is a detail sectional view taken along line 8—8 in FIG. 7 showing the girder stiffener angle and hand rail angle.
Figure 9:
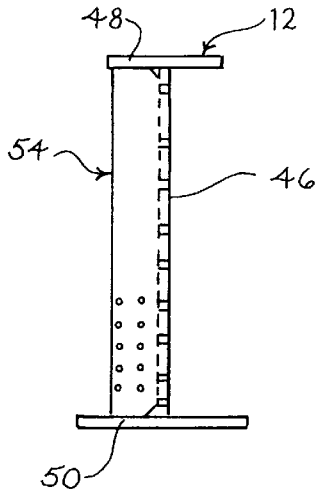
FIG. 9 is a detail sectional view taken along line 9—9 in FIG. 7 showing another girder stiffener angle.

The first girder 12 is illustrated in FIGS. 6 and 7. The second girder 14 is not illustrated because it is simply constructed as the mirror image of the first girder 12. For the illustrated 48 foot steel trestle, girder 12 is constructed as welded plate girder including a web 46 and top and bottom flanges 48 and 50. In the illustrated embodiment, web 46 is constructed of half inch by 48 inch steel plate (FCM) where FCM stands for Fracture Critical. The top flange may be 2×16 steel plate and the bottom flange may be 1⅜×two 4 inch steel plate. The bottom flanges 50 are intentionally wider than top flanges 48 so that each bottom flange extends transversely inwardly from the web 46 toward the opposite girder to a greater extent than the top flange so that floor assemblies 16 and 18 may be lowered between the top flanges 48 for placement onto the bottom flanges 50 during erection. The cross beams of the floor assemblies are actually spaced above the bottom flanges 50 when fully secured to the girders.

The preferred connection of. The floor assemblies to the girders 12 and 14 is by a series of stiffener angles 52 and 54, as shown in FIGS. 1 and 2. The left half of FIG. 1 shows the connection of an end crossbeam 24 to girder 12 by stiffener angle 52, whereas the right half of FIG. 1 shows the connection of center crossbeam 22 to girder 12.

Figure 13:
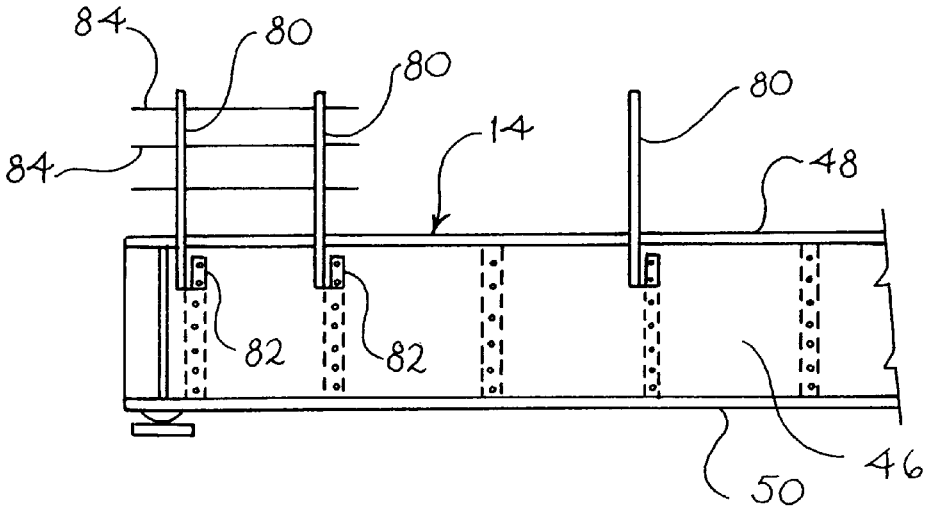
FIG. 13 is a partial side view illustrating hand rail posts of the trestle.

Stiffener angle 52 has a short leg 56 having a vertical array of eight bolt holes situated for alignment with a respective array of bolt holes 60 in the web 46 of girder 12, as shown in FIG. 13. The long leg 62 of stiffener angle 56 has a double row array of ten bolt holes 64 in a lower portion thereof for alignment with the ten bolt holes 32 adjacent the end of end cross beam 24 and a linear array of five bolt holes 66 above that for alignment with and connection to the similar array of five holes 40 and the web 36 of the T-brace 34 which supports the bent curb plates 20. Stiffener angle 54 is the same as angle 52 but without the upper linear array of five bolt holes 66 in the upper portion since no T-brace 34 is connected to the ends center cross beam 22. The illustrated number and arrangement of bolt holes is preferred but is not critical to the invention.

Figure 12:
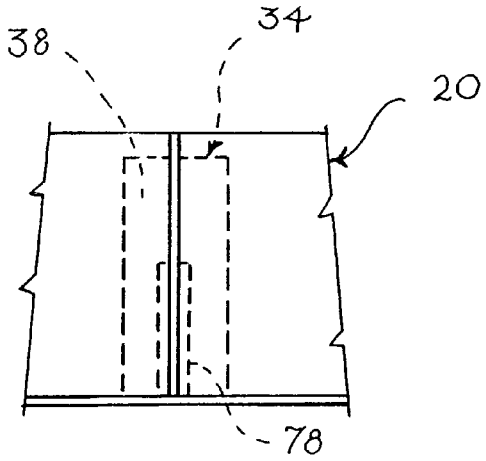
FIG. 12 is a partial side view illustrating the bracing for the bent curb plates of the trestle.

Upon connection of the floor assemblies 16 and 18 to the girders 12 and 14, the bent curb plates 20 are engaged against the upright top flange 38 of the T-braces 34 as shown at the left side of FIG. 1. Each bent curb plate 20 includes a generally horizontal foot portion 68, an intermediate inclined wall portion 70 and a generally upright top wall portion 72. The horizontal foot portion 68 is provided with an array of bolt holes 74 for alignment with the similar array of bolt holes 42 along an edge of ballast floor plate 26. Nut and bolt assemblies 76 extend through the aligned bolt holes for securing the bent curb plate 20 to a respective floor plate 26. Since the bent curb plates are preferably coterminous with the ballast floor plate 26 to which they are secured, the T-braces 34 are shown in FIGS. 3 and 12 as being arranged so that the top flange 38 thereof butts against and is welded to two adjacent bent curb plates 26. Further bracing of adjacent bent curb plates 26 is provided by a backup plate 78 which engages the underside of inclined wall portions 70 and is welded thereto as further shown in FIG. 12.

To complete the assembly of trestle 10, upright hand rail posts 80, shown in FIGS. 13 and 2, are secured to angles 82 on the exterior web of each girder so that wire rope 84 or the like may be strung between the hand rail posts 80 for safety.

Finally, to secure the trestle onto a pile or other substructure, a plate cap 86 may be used as illustrated in FIGS. 10, 11, 6 and 7. The plate cap includes the flat masonry plate 88 having a pair of holes 90 for receiving anchor bolts 92 which are secured within and extend upwardly from the pile or other substructure. A sole plate 94 is welded to the underside of each girder adjacent the end thereof as illustrated in FIG. 7 and includes slots 96 aligned with holes 90 for receiving the anchor bolts 92 onto which nuts 98 are secured.

This invention is further directed to a novel method of constructing a railway short span trestle. The basic steps of the method include providing a pair of first and second girders 12 and 14 and preassembling a selected number of intermediate floor assemblies 16 and a pair of end floor assemblies 18. Pre-assembly of the floor assemblies would preferably be done in a shop environment where the quality of welds and tolerances can be closely controlled. A plurality of cross beams 22 and 24, two in the illustrated embodiment, are arranged in spaced apart relation and secured to a ballast floor plate 26 to maintain the spacing between the cross-beams. At the installation site, the first and second girders 12 and 14 are arranged in generally parallel spaced apart relation. The floor assemblies 16 and 18 are then supported on and between the first and second girders 12 and 14 in adjacent relation to collectively provide a floor which substantially spans the length of the girders. Finally, the floor assemblies are connected to the first and second girders 12 and 14 to provide the unitary trestle.

Preassembly of the floor assembly preferably further includes providing opposite bent curb plates 20 for each floor assembly and securing a pair of the bent curb plates to each respective ballast floor plate 26 in transversely spaced relation so that the bent curb plates extend upwardly and outwardly therefrom in diverging relation for containing ballast on the floor plate to support railway tracks thereon. The floor assemblies 16 and 18 are preferably connected to the first and second girders 12 and 14 by the girder stiffener angles 52 and 54 in the manner previously described.

Any new piles required to provide sub-structure for a replacement short span trestle 10 of the invention are preferably driven outside of the existing trestle structure to minimize track down time for the actual replacement of the trestle.

The method of the invention furthermore preferably includes situating the floor assemblies 16 and 18 entirely within the vertical extent of the first and second girders 12 and 14 and minimizing the vertical distance from the bottom of the girders to the top of the ballast floor plate 26. For spans up to 48 feet, that distance is preferably no greater than about one foot ten and three quarter inches. That compares to two foot seven inches for the same dimension in current trestles for a twenty foot to thirty foot span and three foot seven inches for the same dimension in spans greater than thirty feet.

Whereas the invention has been shown and described in connection with a preferred embodiment thereof, it is understood that many modifications, substitutions, and additions may be made within the intended broad scope of the appended claims.

Thus there has been shown and described a railway short span trestle and method of constructing such a trestle which meet all of the stated objects.

We claim:

1. A railway short span trestle adapted to span and be supported on spaced apart substructures, said trestle comprising, a pair of first and second girders arranged in generally parallel spaced apart relation, a plurality of floor assemblies, said floor assemblies being supported on and between said girders in adjacent relation to collectively provide a floor substantially spanning the length of said girders and operative to support ballast, ties and track substantially spanning the length of said girders, each floor assembly comprising, a plurality of crossbeams arranged in spaced apart relation, and a ballast floor plate supported on and secured to said crossbeams to maintain the spacing between said crossbeams, said floor assemblies connected to said first and second girders thereby to provide a unitary trestle, wherein each girder comprises a respective web, and wherein said trestle comprises a plurality of girder stiffener angles having perpendicular legs with a plurality of bolt holes therein, said girder stiffener angles being rigidly secured to the web of a respective girder in spaced relation for abutment with the cross beams of said floor assemblies, said girder stiffener angles and said cross beams having aligned bolt holes and a plurality of nut and bolt assemblies extended through said aligned bolt holes for securing said floor assemblies to said girders.

2. The railway short span trestle of claim 1 wherein each floor assembly further comprises opposite bent curb plates secured to said ballast floor plate in transversely spaced relation and extended upwardly and outwardly therefrom in diverging relation to one another for containing ballast on said floor to support railway tracks thereon.

3. The railway short span trestle of claim 2 wherein said floor assemblies are situated entirely within the vertical extent of said first and second girders.

4. The railway short span trestle of claim 2 wherein said plurality of floor assemblies includes a plurality of intermediate floor assemblies and a pair of opposite end floor assemblies, each floor assembly including two cross beams, the two cross beams of each intermediate floor assembly including a center cross beam generally centered below the ballast floor plate and an end cross beam underlying one end of the ballast floor plate of that intermediate floor assembly and extending therefrom below the ballast floor plate of an adjacent floor assembly.

5. The railway short span trestle of claim 4 wherein each bent curb plate includes a bottom generally horizontal foot portion, an intermediate inclined wall portion, a generally upright top wall portion, and wherein each floor assembly further comprises bracing supporting said bent curb plates.

6. The railway short span trestle of claim 5 wherein said bracing comprises a pair of upright T-braces mounted on the top of a cross beam of each floor assembly and adjacent the ends of said cross beam, each T-brace including a web secured to a girder stiffener angle and a top flange in abutment with and secured to said upright top wall portion of one of said bent curb plates.

7. The railway short span trestle of claim 6 wherein said bracing further comprises a backup plate underlying and secured to the inclined wall portions of adjacent bent curb plates.

8. A railway short span trestle adapted to span and be supported on spaced apart substructures, said trestle comprising, a pair of first and second girders arranged in generally parallel spaced apart relation, a plurality of floor assemblies, said floor assemblies being supported on and between said girders in adjacent relation to collectively provide a floor substantially spanning the length of said girders and operative to support ballast, ties and track substantially spanning the length of said girders, each floor assembly comprising, a plurality of crossbeams arranged in spaced apart relation, and a ballast floor plate supported on and secured to said crossbeams to maintain the spacing between said crossbeams, said floor assemblies connected to said first and second girders thereby to provide a unitary trestle, wherein each girder comprises an elongated upright web having top and bottom edges and top and bottom flanges secured to and extending transversely from said top and bottom edges respectively, said bottom flange extending transversely inwardly from said web toward the opposite girder to a greater extent than said top flange whereby floor assemblies may be lowered between said top flanges for placement onto sail bottom flanges.

9. The railway short span trestle of claim 8 wherein said girders are welded plate girders.

10. A method of constructing a railway short span trestle, comprising providing a pair of first and second girders, preassembling a plurality of floor assemblies including providing a plurality of cross beams and a ballast floor plate, arranging said cross beams in spaced apart relation and securing said ballast floor plate to said cross beams thereby maintaining the spacing between said cross beams, arranging said first and second girders in generally parallel spaced apart relation, supporting said plurality of floor assemblies on and between said first and second girders in adjacent relation to collectively provide a floor substantially spanning the length of said girders, and connecting said floor assemblies to said first and second girders thereby providing a unitary trestle;

wherein connecting said floor assemblies to said first and second girders comprises providing a plurality of girder stiffener angles having perpendicular legs with a plurality of bolt holes therein, arranging said girder stiffener angles in spaced apart relation corresponding to the spacing between cross beams of said floor assemblies, rigidly securing each of the girder stiffener angles to the web of a respective girder, providing bolt holes in the end of each cross beam in alignment with the bolt holes of a girder stiffener angle, and extending nut and bolt assemblies through the aligned bolt holes for securing the floor assemblies to the girders.

11. The method of claim 10 wherein preassembling a plurality of floor assemblies further comprises providing opposite bent curb plates for each floor assembly and securing a pair of said bent curb plates to a respective ballast floor plate in transversely spaced relation whereby said pair of said bent curb plates extend upwardly and outwardly therefrom in diverging relation for containing ballast on said floor to support railway tracks thereon.

12. The method of claim 11 further comprising situating said floor assemblies entirely within the vertical extent of said first and second girders.

13. The method of claim 10 wherein said step of preassembling a plurality of floor assemblies includes preassembling a plurality of intermediate floor assemblies and a pair of opposite end floor assemblies, each floor assembly including two cross beams, the cross beams of each intermediate floor assembly including a center cross beam generally centered below the ballast floor plate and an end cross beam underlying one end of the ballast floor plate of that intermediate floor assembly and extending therefrom below the ballast floor plate of an adjacent floor assembly.

14. The method of claim 13 further comprising bracing each bent curb plate against outward transverse movement toward the adjacent girder.

15. The method of claim 14 wherein the step of bracing said bent curb plates comprises providing a pair of upright T-braces, mounting said pair of upright T-braces on the top of a respective crossbeam of each floor assembly adjacent the ends of said crossbeam, securing a web of each T-brace to a girder stiffener angle and securing a top flange of the T-brace in abutment with the upright top wall portion of one of said bent curb plates.

16. The method of claim 15 wherein bracing said bent curb plates further comprises providing a backing plate, arranging said backing plate in abutment with the underside of the inclined wall portions of a pair of adjacent bent curb plates and securing said backup plate to both bent curb plates.

17. The method of claim 10 further comprising erecting said railway short span trestle near a plurality of substructures and placing said trestle as a unit onto said substructures.

18. A method of constructing a railway short span trestle, comprising providing a pair of first and second girders, preassembling a plurality of floor assemblies including providing a plurality of cross beams and a ballast floor plate, arranging said cross beams in spaced apart relation and securing said ballast floor plate to said cross beams thereby maintaining the spacing between said cross beams, arranging said first and second girders in generally parallel spaced apart relation, supporting said plurality of floor assemblies on and between said first and second girders in adjacent relation to collectively provide a floor substantially spanning the length of said girders, and connecting said floor assemblies to said first and second girders thereby providing a unitary trestle, wherein the step of providing first and second girders comprises providing girders having an elongated upright web with top and bottom edges and top and bottom flanges secured to and extending transversely from said top and bottom edges with the bottom flange extending transversely inwardly from the web toward the opposite girder to a greater extent than the top flange, and lowering a floor assembly between said top flanges of said girders for placement onto said bottom flanges.

* * * * *

UNITED STATES PATENT AND TRADEMARK OFFICE

CERTIFICATE OF CORRECTION

PATENT NO. : 6,055,693

DATED : May 2, 2000

INVENTOR(S) : Bradley R. Lehr et al.

It is certified that error appears in the above-identified patent and that said Letters Patent is hereby corrected as shown below:

On the Title Page

In column 2, line 11, under "ABSTRACT", change "including tho" to --including the--.

In the Claims

In Claim 8, line 28, change "sail" to --said--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*